US005385113A

United States Patent [19]

Hierath

[11] Patent Number: 5,385,113

[45] Date of Patent: Jan. 31, 1995

[54] TENNIS SCORE KEEPER AND DISPLAY DEVICE

[75] Inventor: Leonard L. Hierath, Denver, Colo.

[73] Assignee: VR Company, Denver, Colo.

[21] Appl. No.: 148,095

[22] Filed: Nov. 5, 1993

[51] Int. Cl.[6] ..... G08B 5/00

[52] U.S. Cl. ..... 116/222; 273/162 A; 273/29 R; D10/46.1

[58] Field of Search ..... 273/29 R; 116/222; D10/46.1

[56] References Cited

U.S. PATENT DOCUMENTS

| | | | |
|---|---|---|---|
| D. 205,077 | 6/1966 | Green | D34/8 |
| D. 300,435 | 3/1989 | Harris et al. | D20/19 |
| 1,853,901 | 4/1932 | Johnson | 116/222 |
| 2,208,009 | 7/1940 | Rosenbloom | 116/222 |
| 3,144,252 | 8/1964 | Saunders | 273/130 |
| 3,220,127 | 11/1965 | Wilson | 40/102 |
| 3,397,839 | 8/1968 | Wegner | 116/222 |
| 4,831,956 | 5/1989 | Thater | 116/222 |
| 5,025,748 | 1/1991 | Pettis | 116/222 |
| 5,062,381 | 11/1991 | Hendricks | 116/222 |
| 5,084,695 | 1/1992 | Freeman | 116/222 |

FOREIGN PATENT DOCUMENTS

| | | | |
|---|---|---|---|
| 3925932 | 2/1991 | Germany | 273/D26 |
| 2966 | of 1893 | United Kingdom | 273/29 R |
| 103798 | 2/1917 | United Kingdom | 116/222 |
| 2053003 | 4/1981 | United Kingdom | 273/D26 |

*Primary Examiner*—Theatrice Brown

*Attorney, Agent, or Firm*—Michael R. Swartz; John R. Flanagan

[57] ABSTRACT

A tennis score keeper and display device includes an elongated support pole, a pair of attachment brackets mounted at locations spaced from one another along the support pole and being adapted to secure the support pole to and alongside a tennis net support post, and a score display mast mounted to an upper end of the support pole. The mast has a pair of opposite vertical end portions and a pair of opposite vertical side portions extending between and interconnecting the opposite end portions. A row of vertically spaced numbers are defined on each of the opposite vertical side portions of the score display mast. A row of vertically spaced pockets are defined on each of the opposite vertical end portions of the score display mast. The pockets in one row thereof on one opposite vertical end portion of the mast are horizontally aligned with the pockets in the other row thereof on the other opposite vertical end portion and are horizontally aligned with the numbers in the rows thereof on the opposite vertical side portions of the mast. Each pocket is recessed into a respective one of the vertical end portions and has opposite open sides and an open end to receive and hold a tennis ball therein to serve as a marker of one of the vertically spaced numbers to indicate a score corresponding to the one number. The open sides and end of each pocket permits the tennis ball to be visible within a viewing angle including substantially the opposite vertical side portion and one opposite vertical end portion of the mast.

20 Claims, 6 Drawing Sheets

TENNIS SCORE KEEPER AND DISPLAY DEVICE

BACKGROUND OF THE INVENTION

1. Field of the Invention

The present invention generally relates to score keeping devices for athletic contests and, more particularly, is concerned with a device for keeping and displaying the total status of a tennis match in terms of the sets score and games score of the current set.

2. Description of the Prior Art

When competitive amateur tennis matches are being played, the players need a convenient way of posting the score. This is especially true during tournament matches or team play where spectators, captains and coaches want to know the score but cannot question the players without disrupting the match.

The most commonly used technique of posting the score is referred to as a flip card method of posting the score. In this technique, a T-bar score posting unit having a T-bar is mounted by its vertical member on one of the net posts and a pair of sets of numbered flip cards are supported from a pair of opposite top cross members of the T-bar. Each flip card has a pair of small through-holes defined therethrough adjacent to the top edge of the card. Metal rings are extended through these holes and disposed over the top cross members so as to support the sets of flip cards below the respective cross members of the T-bar. The numbers are printed in sequence on both front and back sides of the flip cards. The cards must be flipped over until the correct numbers are exposed to post the score.

This flip card method of posting the score has several disadvantages which make it less than an optimum technique for informing spectators, captains and coaches of the scoring progress of the match. First, the flip cards and rings fall off the top cross members of the T-bar quite easily. Second, the projecting cross bars are hazardous to the players. Third, the flip cards are tedious to use. The user has to lift each card to see if the number being sought is displayed on the opposite side of the current number being displayed. This creates considerable fumbling around to find and post the correct score. Fourth, the T-bar score posting unit will rotate from the desired position on a windy day. Fifth, the flip cards typically do not display the sets score. Sixth, the T-bar score posting unit is quite fragile and brittle and frequently break. Seventh, this unit cannot be used to post the score of a 10-game pro-set.

Various other score keeping devices have been proposed in the prior patent art. Representative of the prior art devices are the ones disclosed in U.S. Pat. Nos. to Saunders (3,144,252), Wilson (3,220,127), Thater (4,831,956) and Pettis (5,025,748), U.S. Des. Nos. to Green (205,077) and Harris et al (300,435), a U.K design patent to Wilkinson et al (2,966), a U.K. patent application to Nightingale (2,053,003) and a German patent to Peter (3,925,932). However, none of the scope keeping devices of the above-cited patents appear to provide an effective solution to the above-described disadvantages of the current T-bar score posting unit.

Consequently, a need still exists for improvement in techniques for keeping and displaying the total status of a tennis match in terms of the sets score and games score of the current set.

SUMMARY OF THE INVENTION

The present invention provides a tennis score keeper and display device designed to satisfy the aforementioned needs. Unlike the flip card method employed by the prior art T-bar score posting unit, the score keeper and display device of the present invention is adapted for keeping and displaying the total status of a tennis match in terms of the sets score and game score of the current set. Also, the score keeper and display device is easier to use and to see than the prior art flip card method by employing highly visible and readily available tennis balls as the markers to display the score. Even from several courts away, viewers can tell the score by the relative position of the balls on the device.

Accordingly, the present invention is directed to a tennis score keeper and display device. The device comprises: (a) an elongated support pole; (b) means for securing the support pole to and alongside a tennis net support post; (c) a score display mast mounted to an upper end of the support pole, the mast having a pair of opposite vertical end portions and a pair of opposite vertical side portions extending between and interconnecting the opposite end portions; (d) means for defining a row of vertically spaced numbers on each of the opposite vertical side portions of the score display mast; and (e) means for defining a row of vertically spaced pockets on each of the opposite vertical end portions of the score display mast. The pockets in the row thereof on one of the opposite vertical end portions of the mast being substantially horizontally aligned with the pockets in the row thereof on the other of the opposite vertical end portions of the mast and with the numbers in the rows thereof on the opposite vertical side portions of the mast. Each of the pockets is recessed into a respective one of the vertical end portions and has opposite open sides and an open end and is of a size to receive and hold an object, such as a tennis ball, therein to serve as a marker of one of the vertically spaced numbers to indicate a score corresponding to the one number. The opposite open sides and open end of the pocket permits the object held in the pocket to be visible within a viewing angle which substantially includes the opposite vertical side portions and the one opposite vertical end portion of the mast.

More particularly, the score display mast includes a pair of sheet members each being bent along a longitudinal extent thereof so as to have substantially U-shaped cross section and define a pair of respective opposite flat sides and a rounded end connecting the flat sides. The U-shaped sheet members are interfitted so as to overlap one another at the opposite sides thereof. The overlapped opposite sides of the sheet members define the opposite side portions of the mast, while the rounded end of each sheet member defines one of the opposite end portions of the mast. The rounded end of each sheet member contains a row of vertically spaced oblong openings which define one of the rows of vertically spaced pockets.

The support pole securing means includes a pair of attachment brackets. Each attachment bracket includes a strap clamp component having an elongated strap portion and an end clamp portion, an U-shaped bracket component being disposed between the end clamp portion and an end section of the strap portion, and a fastener adapted to attach the end clamp portion, bracket component and end section of the strap portion together to secure the attachment bracket to the net post with the strap portion tightly encircling the net post. The end clamp portion of the strap clamp component is folded and thereby formed from a blank being integrally connected to the strap portion of the strap clamp component.

The tennis score keeper and display device further comprises a gauge rod attached on the support post adjacent to the upper end thereof. The gauge rod extends outwardly from the support pole for engaging a top end of the tennis net post to set the vertical position of the support pole and score posting mast relative to the tennis net post.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
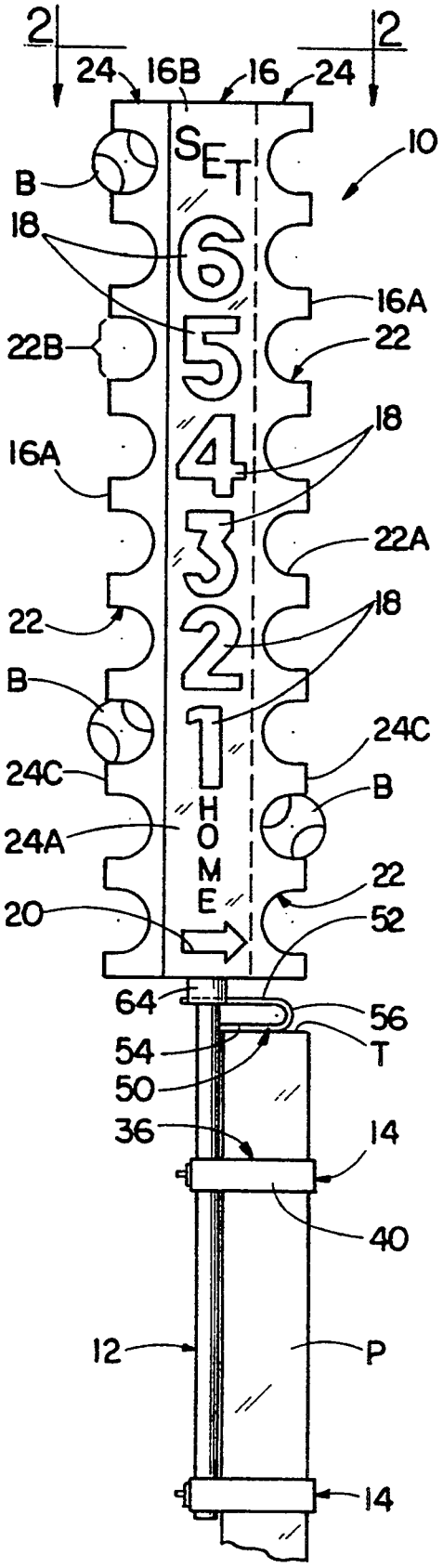
FIG. 1 is a front elevational view of a tennis score keeping and displaying device of the present invention shown mounted upright from one of the tennis net support posts.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Figure 3:
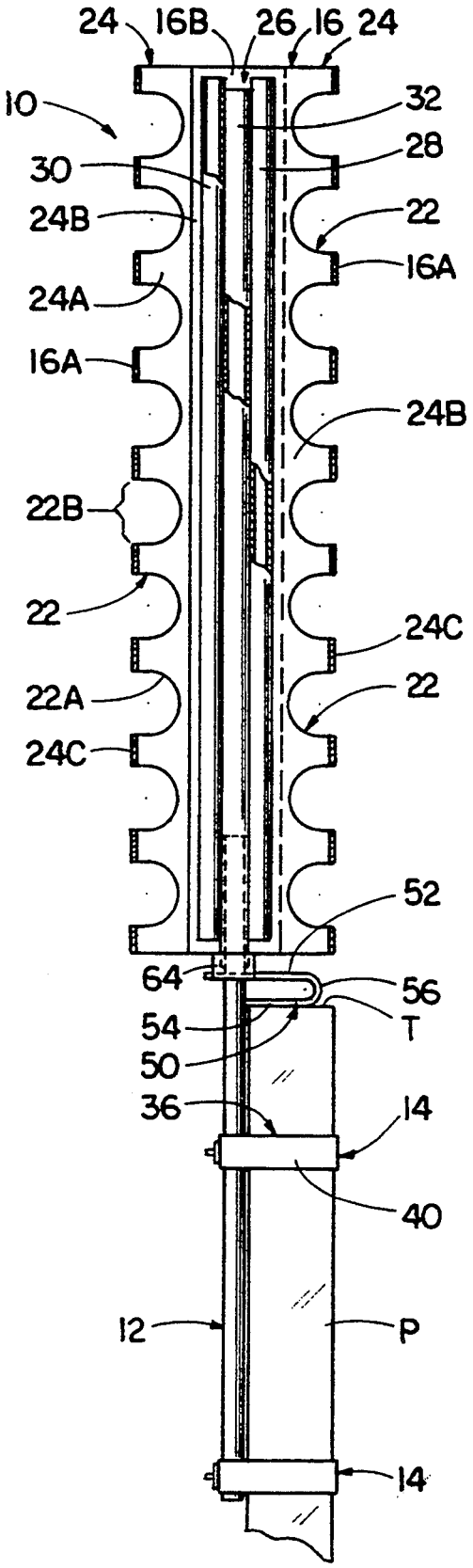
FIG. 3 is a longitudinal sectional view of a score display mast of the device taken along line 3—3 of FIG. 2.
Figure 9:
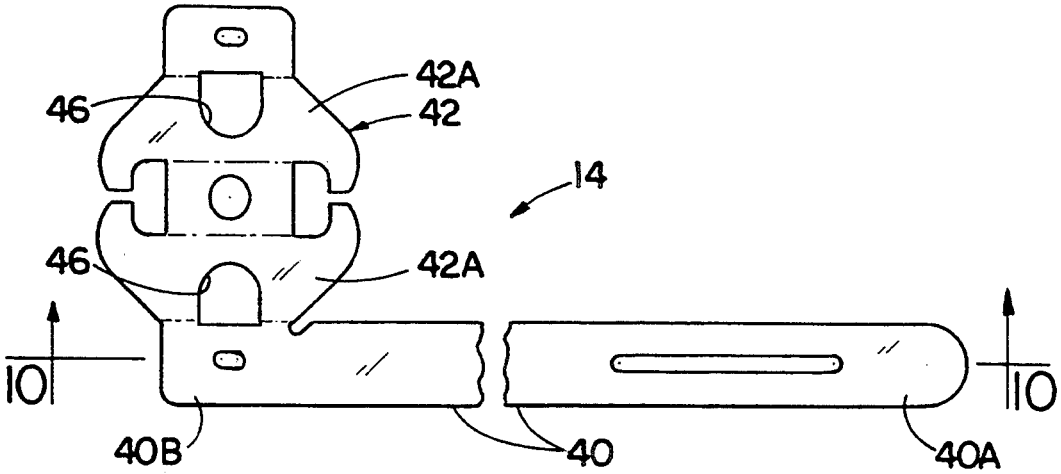
FIG. 9 is a plan view of a blank before being folded into a strap clamp component of the attachment bracket of FIG. 7.
Figure 10:
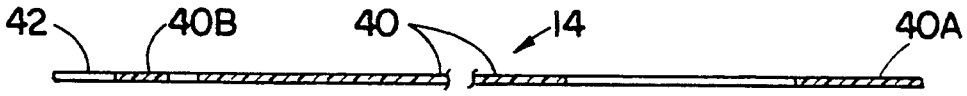
FIG. 10 is a longitudinal sectional view of a strap portion of the strap clamp component taken along line 10—10 of FIG. 9.
Figure 2:
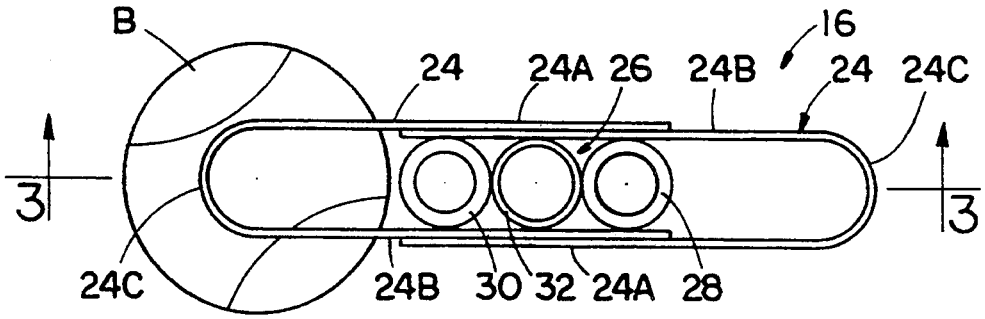
FIG. 2 is a top end elevational view of the device as seen along line 2—2 of FIG. 1.
Figure 15:
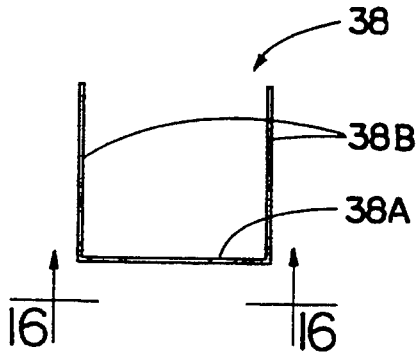
FIG. 15 is a top plan view of the U-shaped bracket component of the attachment bracket of FIG. 7.
Figure 16:
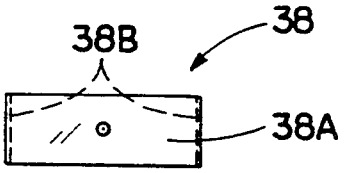
FIG. 16 is an end elevational view of the U-shaped bracket component of the attachment bracket as seen along line 15—15 of FIG. 15.

Referring now to the drawings, and particularly to FIGS. 1-3, there is shown a tennis score keeper and display device 10 of the present invention mounted to a tennis net post P. In its basic components, the device includes an elongated support pole 12, a pair of attachment brackets 14 mounted at locations spaced from one another along the support pole 12 and being adapted to secure the support pole 12 to and alongside a tennis net support post P, and a score display mast 16 mounted to an upper end 12A of the support pole 12. The score display mast 16 has a pair of opposite vertical end portions 16A and a pair of opposite vertical side portions 16B extending between and interconnecting the opposite end portions 16A. A row of vertically spaced numbers 18, such as one through six, and an arrow 20 are defined on each of the opposite vertical side portions 16B of the score display mast 16. A row of vertically spaced pockets 22 are defined on each of the opposite vertical end portions 16A of the score display mast 16. The pockets 22 in one row thereof on one opposite vertical end portion 16A of the mast 16 are substantially horizontally aligned with the pockets 22 in the other row thereof on the other opposite vertical end portion 16A of the mast 16 and also are substantially horizontally aligned with the numbers 18 (one through six) in the rows thereof on the opposite vertical side portions 16B of the mast 16. Thus, the opposite vertical side portions 16B, and the respective rows of vertically spaced numbers 18 thereon, face in opposite directions away from one another, and the opposite vertical end portions 16A, and the respective rows of vertically spaced pockets 22 defined thereon, face in opposite directions away from one another.

More particularly, referring to FIGS. 1-4, the score display mast 16 includes a pair of elongated sheet members 24 and an elongated central mounting member 26 disposed between the sheet members 24. Each sheet member 24 is bent along and about a longitudinal centerline so as to have a substantially U-shaped cross section, as best shown in FIG. 2, which defines a pair of respective opposite flat sides 24A, 24B and a rounded end 24C connected therebetween. The U-shaped sheet members 24 are interfitted so as to be offset from and overlapped with one another along the opposite sides 24A, 24B thereof. The pairs of overlapped opposite sides 24A, 24B of the sheet members 24 together define the respective opposite vertical side portions 16B of the mast 16, while the oppositely spaced rounded ends 24C of the respective sheet members 24 define the opposite vertical end portions 16A of the mast 16. The central mounting member 26 is disposed between and attached to the pairs of overlapped opposite sides 24A, 24B of the sheet members 24. The central mounting member 26 can take any suitable form. In one exemplary form shown in FIGS. 2 and 3, the central mounting member 26 is formed by a plurality of elongated tubes 28, 30, 32 disposed in a side-by-side relationship to one another and fastened to one another.

Figure 4:
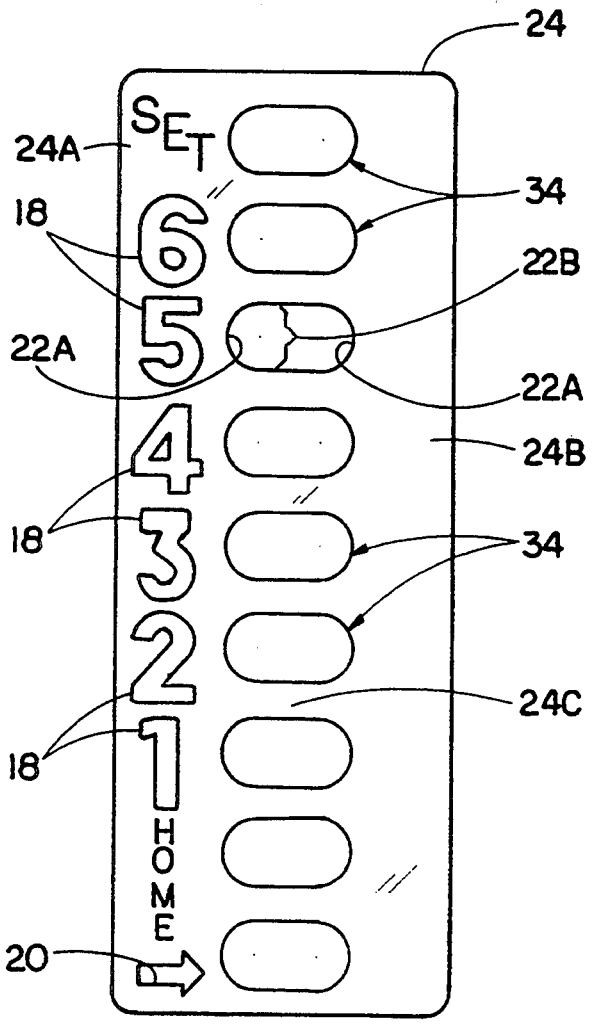
FIG. 4 is a plan view of one of the sheets used to construct the score display mast of the device of FIG. 1.

Referring to FIGS. 1, 2 and 4, the rounded end 24C of each sheet member 24 contains a row of vertically spaced oblong openings 34 which define one of the rows of vertically spaced pockets 22 once the sheet member 24 is placed in the U-shaped configuration. Each pocket 22 is recessed into the rounded end 24C of the respective sheet member 24 and has opposite open sides 22A and an open end 22B being sized to receive and hold a resiliently compressible object, such as a conventional tennis ball B, therein, as seen in FIGS. 1 and 2, to serve as a marker of one of the vertically spaced numbers 18 and thereby to indicate a score corresponding to the one number. As can be seen in FIG. 2, the open sides 22A and open end 22B of the pocket 22 permits the tennis ball B to project beyond the respective vertical end portion 16A and opposite vertical side portions 16B so as to be visible within a viewing angle of at least 180° that includes the opposite vertical side portions 16B and one opposite vertical end portion 16A of the mast 16.

Referring to FIGS. 1 and 4, the row of vertically spaced numbers 18 being substantially horizontally aligned with the pockets 22 are defined by a series of die cuts in the shape of the numbers 18 one to six made in one flat side 24A of each of the sheet members 24. These flat sides 24A containing the die cut numbers 18 overlap with flat sides 24B which do not contain the die cut numbers 18. Due to the fact that the one of the sheet members 24 is darker in color than the other of the sheet members 24, such as dark green versus white, the color contrast between the overlapped outer flat sides 24A of the respective sheet members 24 which contain the die cut numbers 18 and inner flat sides 24B of the sheet members 24 that do not contain the die cut numbers 18 define the numbers 18 in the color of the overlapped inner sides 24B of the respective sheet members 24. Thus, on one of the side portions 16B of the mast 16 the numbers 18 are green, while on the other of the side portions 16B thereof the numbers 18 are white.

Referring to FIGS. 1, 2, 5, 6 and 7–16, each attachment bracket 14 securing the support pole 12 to the net post P includes a strap clamp component 36 and an U-shaped bracket component 38. The strap clamp component 36 has an elongated strap portion 40 and an end clamp portion 42. The U-shaped bracket component 38 is disposed between the end clamp portion 42 and one end section 40A of the strap portion 40 of the strap clamp component 36. Each attachment bracket 14 also includes a fastener 44 adapted to attach the end clamp portion 42, the bracket component 38 and the end section 40A of the strap portion 40 together so as to mount the attachment bracket 14 to the support pole 12 and to secure the attachment bracket 14 about the desired location on the net post P with the strap portion 40 encircling the net post P.

As seen in FIGS. 9–14, the end clamp portion 42 of the strap clamp component 36 is erected by being folded into a box-shaped configuration from a blank (FIG. 9) which is integrally connected along an edge of an opposite end section 40B of the strap portion 40. The U-shaped bracket component 38 is captured at a base portion 38A thereof between the erected end clamp portion 42 and opposite end section 40B of the strap portion 40. The ends of a pair of leg portions 38B of the bracket component 38 project beyond the erected end clamp portion 42 so as to engage spaced locations on the net post P.

Figure 5:
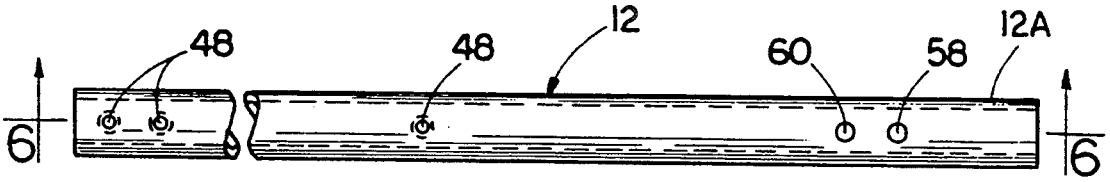
FIG. 5 is a longitudinal elevational view of a support post of the device mounting the score display mast.
Figure 6:
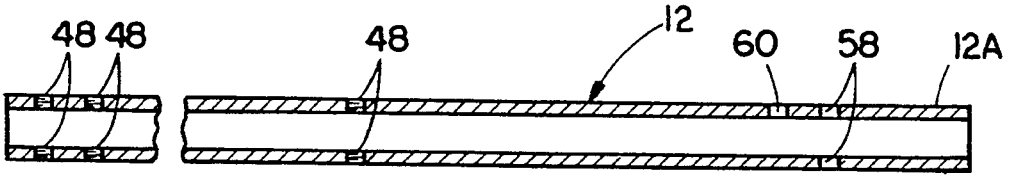
FIG. 6 is a longitudinal sectional view of the support tube taken along line 6—6 of FIG. 5.
Figure 7:
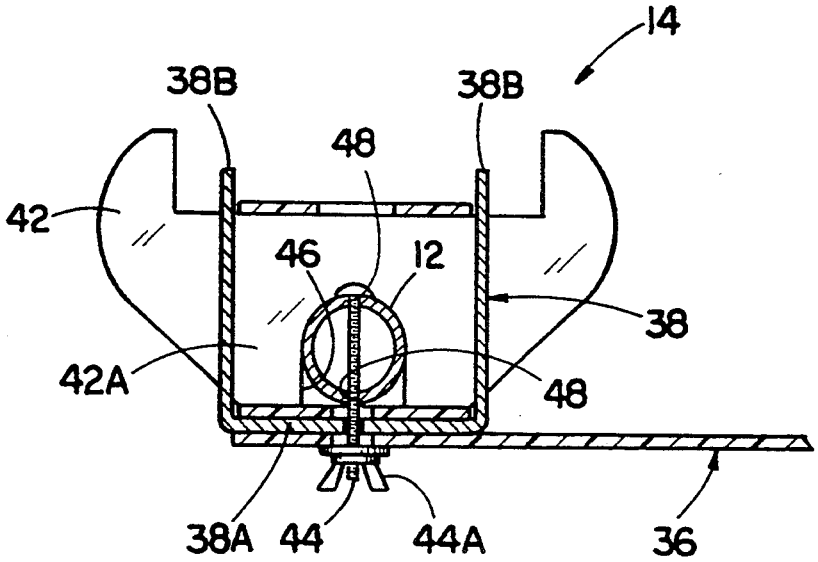
FIG. 7 is a top plan view of one of a pair of attachment brackets of the device of FIG. 1, being shown prior to securement of the bracket to one of the posts supporting an end of a tennis net.
Figure 8:
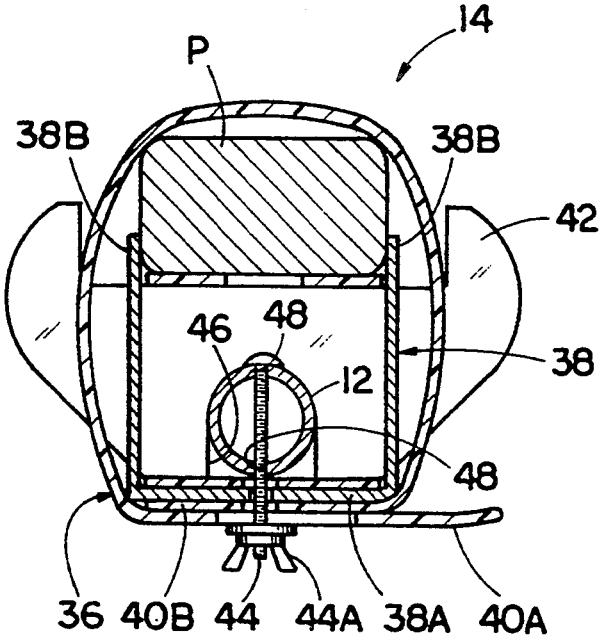
FIG. 8 is a view similar to that of FIG. 7 but showing the attachment bracket after securement of the bracket to the one tennis net support post.
Figure 11:
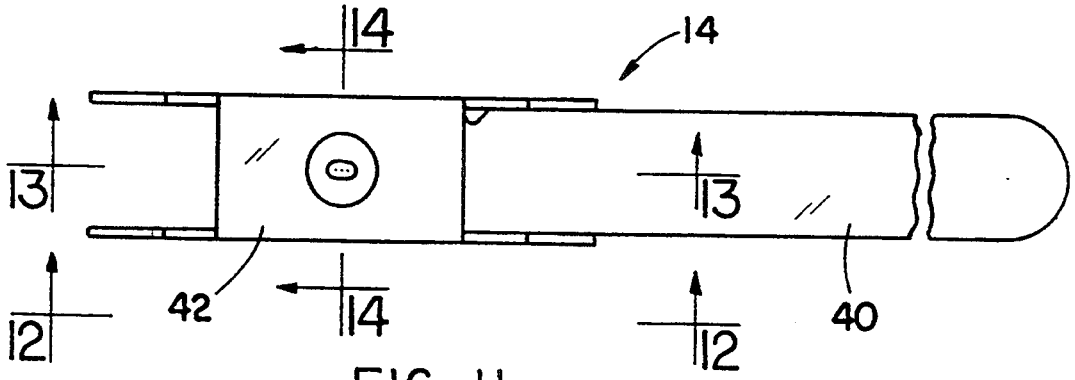
FIG. 11 is a front elevational view of the folded strap clamp component of the attachment bracket of FIG. 7.
Figure 12:
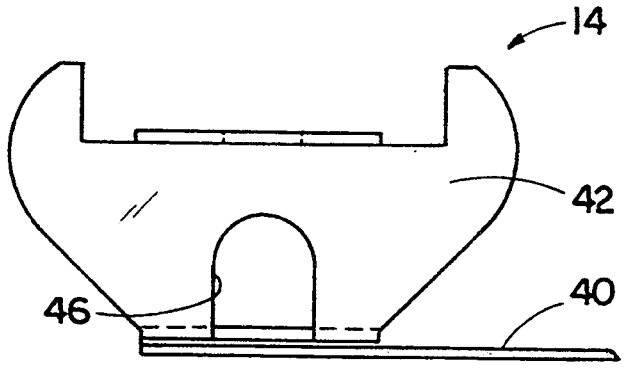
FIG. 12 is top plan view of the folded strap clamp component as seen along line 12—12 of FIG. 11.
Figure 14:
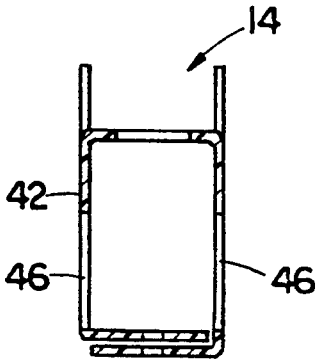
FIG. 14 is a cross sectional view of the folded strap clamp component taken along line 14—14 of FIG. 11.
Figure 13:
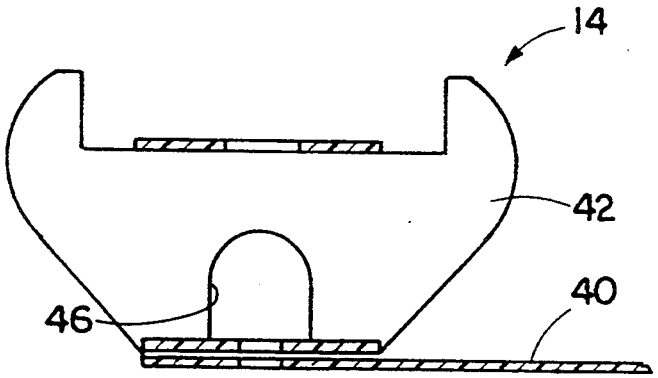
FIG. 13 is a longitudinal sectional view of the folded strap clamp component taken along line 13—13 of FIG. 11.
Figure 17:
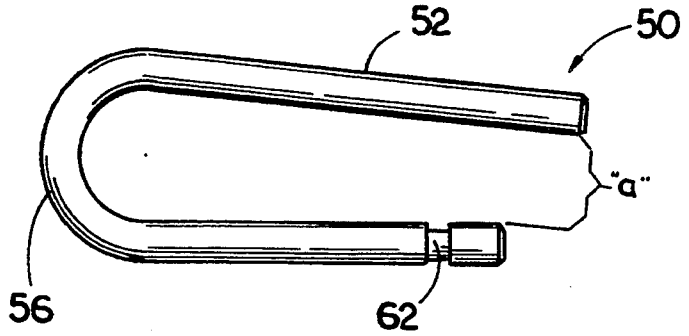
FIG. 17 is a side elevational view of a gauge rod of the device of FIG. 1.

The support pole 12 passes through a pair of aligned openings 46 formed through the opposite sides 42A of the erected end clamp portion 42. As seen in FIGS. 5 and 6, the support pole 12 has pairs of aligned apertures 48 defined therein through which extends the fastener 44 of each attachment bracket 14. A wing nut 44A is manually threadable on the threads of the fastener 44 for securing the bracket 14 to the support pole 12 and net post P.

Figure 18:
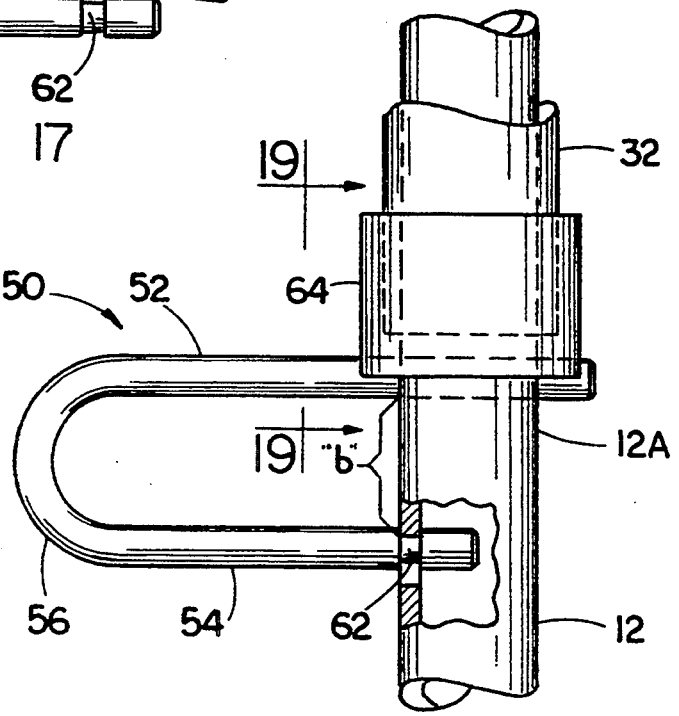
FIG. 18 is an enlarged fragmentary side elevational view of the gauge rod installed in the support pole of the device of FIG. 1, showing the gauge rod oriented at a position rotated 180° from its position shown in FIG. 1.

Referring to FIGS. 1, 2 and 17–20, the tennis score keeper and display device 10 further includes a gauge rod 50 releasably attached on the support post 12 adjacent to the upper end 12A thereof and extending outwardly therefrom for engaging a top end T of the tennis net post P in order to set the desired vertical position of the support pole 12 and score posting mast 16 relative to the tennis net post P. The gauge rod 50 has a pair of upper and lower legs 52, 54 and a rounded bight 56 extending between and interconnecting the upper and lower leg 52, 54. The support pole 12 has spaced holes 58, 60 defined therethrough adjacent to the upper end 12A of the pole 12 for receiving ends of the legs 52, 54 of the gauge rod 50, as seen in FIG. 18. The spacing "a" between the holes 58, 60 in the upper end 12A of the support pole 12 is greater than the spacing "b" between the ends of the legs 52, 54 of the gauge rod 50. The gauge rod 50 is fabricated of a resilient springy material which permits the upper and lower legs 52, 54 thereof to be temporarily forced farther apart such that the spacing "b" between the ends of the legs 52, 54 matches the spacing "a" between the holes 58, 60 in the support pole 12 so as to facilitate insertion of the ends of the upper and lower legs 52, 54 of the gauge rod 50 through and retention of the leg ends in the holes 58, 60 of the support pole 12. The end of one of the legs 54 terminates short of the end of the other of the legs 52 and contains an annular groove 62 which interlocks with the portion of the support pole 12 defining the one hole 60.

Figure 19:
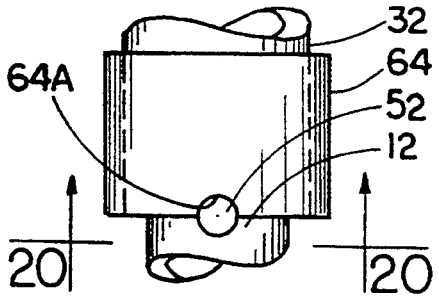
FIG. 19 is a side elevational view of an indexing collar attached to a lower end of the score display mast having detents for nesting over the gauge rod to permit the mast to be in only two positions relative to the gauge rod which are rotated 180° from one another.
Figure 20:
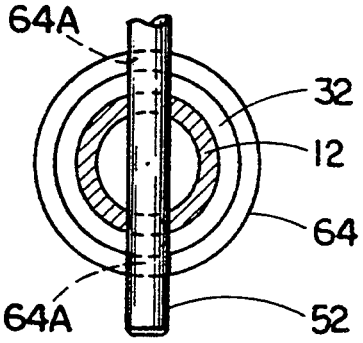
FIG. 20 is a bottom plan view of the indexing collar as seen along line 20—20 of FIG. 19.

Referring to FIGS. 18–20, the score display mast 16 of the device 10 includes an annular collar 64 mounted to the lower end of the center tube 32 of the central mounting member 26 of the mast 16. The annular collar 64 fits over the upper end 12A of the support pole 12 when the latter is received into the center tube 32 of the mast 16. The annular collar 64 has a pair of arcuate detents 64A defined in a lower end thereof which have configurations matching the circular cross-sectional shape of the upper leg 52 of the gauge rod 50. Thus, the annular collar 64 seats upon the upper leg 52 of the gauge rod 50 in either one of two rotational positions being displaced 180° from one another. The mast 16 can be lifted relative to the support pole 12 and rotated 180° to change its orientation when the players switch sides on the tennis court.

Therefore, the gauge rod 50 for setting the vertical position of the support pole 12 and score posting mast 16 relative to the net post P is installed in the holes 58, 60 in the support pole 12 by forcing its upper and lower legs 52, 54 farther apart to match the spacing of the support pole holes 58, 60. This action on the rod 50 provides upward spring tension on the grooved lower leg 54 of the gauge rod 50, holding it firmly against the wall of the support pole 12. The direction of spring-bias of the gauge rod 50 is in the same direction as force which is transmitted to the rod 50 while it is installed on the net post P during use. Thus, normal forces on the rod 50 will not loosen the rod 50 from its installed position. The upper leg 52 of the gauge rod 50 provides the reference point for the score keeping mast 16, holding it in the desired perpendicular position relative to the net while permitting the mast 16 to be rotated 180° at player changeover.

In a representative example of the score keeper and display device 10, the mast 16 is manufactured of impact resistant (die-cut) high density polyethylene sheets poprivet fastened to PVC tubes forming the central mounting member 26. The net post-mounted support pole 12 is fabricated of a high strength aluminum tube. The attachment brackets 14 are die-cut from high density polyethylene. The gauge rod 50 is a grooved high strength aluminum rod formed into the U-shape and inserted into the cross holes 58, 60 drilled into the support pole 12.

In summary, the tennis score keeper and display device 10 of the present invention has the following advantages and benefits for users: (1) creates a system which is easier to use than the prior art flip cards; (2) uses highly visible and readily available tennis balls as the markers to display the score; (3) employs a mast 16 having a thin profile so that the score is visible from nearly any viewing angle; (4) provides an interference fit of the tennis balls with the ball pockets 22 defined vertically in the mast 16 so that the balls will not be blown out nor easily fall out, if the device is bumped; (5) provides a durable, impact resistant, design which can survive direct hits by a ball or tennis racket and also survive in the sun and in freezing weather; (6) provides detent positions at 180° so that the device 10 stops perpendicular to the net on rotation at the changeover of the players, thereby preventing the wind from rotating the device; (7) provides a design which uses vertical space and thus is safer for the players; (8) avoids the use of paints and aerosols and adhesive backed numbers by using permanent die-cut features; (9) provides a means of posting both the games won and the sets won and also scoring in a 10-game pro-set (for example, in FIG. 1, the games won score is the away player 1, the home player 0, with the away player also ahead in sets score, 1 to 0; (10) provides a means of attachment to the net post which can be made without the need to use tools; (11) provides attachment members which can be quickly released if the device must be put in storage each night or alternatively can provide a permanent securement of the device to the net post; (12) provides a design that is compatible with the traditional green court colors; and (13) provides a design that can be easily repaired, if needed.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A tennis score keeper and display device, comprising:

(a) an elongated support pole;

(b) means for securing said support pole to and alongside a tennis net support post;

(c) a score display mast mounted to an upper end of said support pole, said mast having a pair of opposite vertical end portions and a pair of opposite vertical side portions extending between and interconnecting said opposite end portions;

(d) means defining a row of vertically spaced numbers on each of said opposite vertical side portions of said score display mast, said opposite vertical side portions and said respective rows of vertically spaced numbers thereon facing in opposite directions away from one another; and (e) means defining a row of vertically spaced pockets on each of said opposite vertical end portions of said score display mast, said pockets in said row thereof on one of said opposite vertical end portions of said mast being substantially horizontally aligned with said pockets in said row thereof on the other of said opposite vertical end portions of said mast and with said numbers in said rows thereof on said opposite vertical side portions of said mast, said opposite vertical end portions and said respective rows of vertically spaced pockets defined thereon facing in opposite directions away from one another.

2. The device as recited in claim 1, wherein each of said pockets is recessed into a respective one of said vertical end portions and has opposite open sides and an open end and is of a size to receive and hold an object therein to serve as a marker of one of said vertically spaced numbers to indicate a score corresponding to said one number, said opposite open sides and open end of said pocket permitting the object to be visible within a viewing angle which substantially includes said opposite vertical side portions and said one opposite vertical end portion of said mast.

3. A tennis score keeper and display device, comprising:

(a) an elongated support pole;

(b) means securing said support pole to and alongside a tennis net support post;

(c) a score display mast mounted to an upper end of said support pole, said mast having a pair of opposite vertical end portions and a pair of opposite vertical side portions extending between and interconnecting said opposite end portions;

(d) means defining a row of vertically spaced numbers on each of said opposite vertical side portions of said score display mast; and (e) means defining a row of vertically spaced pockets on each of said opposite vertical end portions of said score display mast, said pockets in said row thereof on one of said opposite vertical end portions of said mast being substantially horizontally aligned with said pockets in said row thereof on the other of said opposite vertical end portions of said mast and with said numbers in said rows thereof on said opposite vertical side portions of said mast;

(f) said score display mast including a pair of sheet members each being bent along a longitudinal extent thereof so as to have substantially U-shaped cross section and define a pair of respective opposite flat sides and a rounded end connecting the flat sides, said U-shaped sheet members being interfitted so as to overlap one another at said opposite sides thereof, said overlapped opposite sides of said sheet members defining said opposite side portions of said mast, said rounded end of each of said sheet members defining one of said opposite end portions of said mast.

4. The device as recited in claim 3, wherein said means defining said row of vertically spaced numbers includes a series of die cuts in the shape of said numbers made in one of said flat sides of one of said sheet members.

5. The device as recited in claim 4, wherein said means defining said row of vertically spaced numbers also includes one of said sheet members being darker in color than the other of said sheet members such that the color contrast between the flat side of one of said sheet members and the flat side of the other of said sheet members containing said die cut numbers and overlapping the flat side of the one sheet member defines said numbers on said vertical side portion of said mast.

6. The device as recited in claim 3, wherein said score display mast also includes an elongated central mounting member disposed between and attached to said overlapped opposite sides of said sheet members.

7. The device as recited in claim 6, wherein said central mounting member of said mast includes a plurality of elongated tubes disposed in side-by-side relationship to one another.

8. The device as recited in claim 3, wherein said rounded end of each of said sheet members contains a row of vertically spaced oblong openings which define one of said rows of vertically spaced pockets.

9. A tennis score keeper and display device, comprising:

(a) an elongated support pole;

(b) means for securing said support pole to and alongside a tennis net support post;

(c) a score display mast mounted to an upper end of said support pole, said mast having a pair of opposite vertical end portions and a pair of opposite vertical side portions extending between and interconnecting said opposite end portions;

(d) means defining a row of vertically spaced numbers on each of said opposite vertical side portions of said score display mast;

(e) means defining a row of vertically spaced pockets on each of said opposite vertical end portions of said score display mast, said pockets in said row thereof on one of said opposite vertical end portions of said mast being substantially horizontally aligned with said pockets in said row thereof on the other of said opposite vertical end portions of said mast and with said numbers in said rows thereof on said opposite vertical side portions of said mast; and (f) a gauge rod attached on said support pole adjacent to said upper end thereof and extending outwardly therefrom for engaging a top end of the tennis net post to set the vertical position of said support pole and score posting mast relative to the tennis net post.

10. The device as recited in claim 9, wherein said gauge rod has a pair of upper and lower legs and a rounded bight extending between and interconnecting said upper and lower leg.

11. The device as recited in claim 10, wherein said support pole has a pair of holes defined therethrough adjacent to said upper end thereof for receiving ends of said legs of said gauge rod.

12. The device as recited in claim 11, wherein the spacing between said holes in said support pole is greater than the spacing between said ends of said legs of said gauge rod, said gauge rod being fabricated of a resilient springy material permitting said upper and lower legs thereof to be forced farther apart to match the spacing of said holes in said support pole so as to facilitate insertion of said ends of said upper and lower legs of said gauge rod through and retention of said legs ends in said holes in said support pole.

13. The device as recited in claim 10, wherein said score display mast also includes an annular collar mounted over said upper end of said support pole, said collar having a pair of detents defined in a lower end thereof for seating upon an upper leg of said gauge rod in either one of two rotational positions being displaced 180° from one another.

14. A tennis score keeper and display device, comprising:

(a) an elongated support pole;

(b) means securing said support pole to and alongside a tennis net support post;

(c) a score display mast mounted to an upper end of said support pole, said mast having a pair of opposite vertical end portions and a pair of opposite vertical side portions extending between and interconnecting said opposite end portions;

(d) means for defining a row of vertically spaced numbers on each of said opposite vertical side portions of said score display mast; and (e) means for defining a row of vertically spaced pockets on each of said opposite vertical end portions of said score display mast, said pockets in said row thereof on one of said opposite vertical end portions of said mast being substantially horizontally aligned with said pockets in said row thereof on the other of said opposite vertical end portions of said mast and with said numbers in said rows thereof on said opposite vertical side portions of said mast;

(f) said support pole securing means including a pair of attachment brackets being mounted at locations spaced from one another along said support pole and adapted to secure said support pole to and alongside the tennis net support post.

15. The device as recited in claim 14, wherein each of said attachment brackets includes:

a strap clamp component having an elongated strap portion and an end clamp portion;

a U-shaped bracket component being disposed between said end clamp portion and an end portion of said strap portion; and a fastener adapted to attach said end clamp portion, said bracket component and said end portion of said strap portion together to secure said attachment bracket to the net post with said strap portion encircling the net post.

16. The device as recited in claim 14, wherein each of said attachment brackets includes a strap clamp component having an elongated strap portion and an end clamp portion, said end clamp portion being folded from a blank being integrally connected to said strap portion.

17. A tennis score keeper and display device, comprising:

(a) an elongated support pole;

(b) a pair of attachment brackets mounted at locations spaced from one another along said support pole and being adapted to secure said support pole to and alongside a tennis net support post;

(c) a score display mast mounted to an upper end of said support pole, said mast having a pair of opposite vertical end portions and a pair of opposite vertical side portions extending between and interconnecting said opposite end portions;

(d) means defining a row of vertically spaced numbers on each of said opposite vertical side portions of said score display mast;

(e) means defining a row of vertically spaced pockets on each of said opposite vertical end portions of said score display mast, said pockets in said row thereof on one of said opposite vertical end portions of said mast being substantially horizontally aligned with said pockets in said row thereof on the other of said opposite vertical end portions of said mast and with said numbers in said rows thereof on said opposite vertical side portions of said mast, each of said pockets being recessed into a respective one of said vertical end portions and having opposite open sides and an open end and being of a size to receive and hold an object therein to serve as a marker of one of said vertically spaced numbers to indicate a score corresponding to said one number, said opposite open sides and open end of said pocket permitting the object to be visible within a viewing angle substantially including said opposite vertical side portions and said one opposite vertical end portion of said mast; and (f) a gauge rod attached on said support post adjacent to said upper end thereof and extending outwardly therefrom for engaging a top end of the tennis net post to set the vertical position of said support pole and score posting mast relative to the tennis net post.

18. The device as recited in claim 17, wherein said gauge rod has a pair of upper and lower legs and a rounded bight extending between and interconnecting said upper and lower leg.

19. The device as recited in claim 18, wherein said support post has a pair of holes defined therethrough adjacent to said upper end thereof for receiving ends of said legs of said gauge rod, the spacing between said holes in said support post being greater than the spacing between said ends of said legs of said gauge rod, said gauge rod being fabricated of a resilient springy material permitting said upper and lower legs thereof to be forced farther apart to match the spacing of said holes in said support pole so as to facilitate insertion of said ends of said upper and lower legs of said gauge rod through and retention of said legs ends in said holes in said support pole.

20. The device as recited in claim 18, wherein said score display mast also includes an annular collar mounted over said upper end of said support pole, said collar having a pair of detents defined in a lower end thereof for seating upon an upper leg of said gauge rod in either one of two rotational positions being displaced 180° from one another.

* * * * *